US010823167B2

(12) United States Patent
Dietzsch et al.

(10) Patent No.: US 10,823,167 B2
(45) Date of Patent: Nov. 3, 2020

(54) PUMP ASSEMBLY

(71) Applicant: WILDEN PUMP AND ENGINEERING LLC, Grand Terrace, CA (US)

(72) Inventors: Curtis W. Dietzsch, Riverside, CA (US); William K. Watson, Sr., Upland, CA (US); Nathan Hale, Hesperia, CA (US); Maclovio Antonio Aguilar Sepulveda, Riverside, CA (US)

(73) Assignee: WILDEN PUMP AND ENGINEERING LLC, Grand Terrace, CA (US)

( * ) Notice: Subject to any disclaimer, the term of this patent is extended or adjusted under 35 U.S.C. 154(b) by 128 days.

(21) Appl. No.: 16/263,203

(22) Filed: Jan. 31, 2019

(65) Prior Publication Data

US 2020/0248683 A1 Aug. 6, 2020

(51) Int. Cl.

| | |
|---|---|
| ***F04B 53/22*** | (2006.01) |
| ***F04B 43/06*** | (2006.01) |
| ***F04B 43/02*** | (2006.01) |
| ***F04B 45/04*** | (2006.01) |
| ***F04B 39/12*** | (2006.01) |
| ***F04B 45/053*** | (2006.01) |
| ***F04B 53/16*** | (2006.01) |
| ***F04B 39/14*** | (2006.01) |

(52) U.S. Cl.

CPC ..... *F04B 53/22* (2013.01); *F04B 39/121* (2013.01); *F04B 39/14* (2013.01); *F04B 43/025* (2013.01); *F04B 43/026* (2013.01); *F04B 43/06* (2013.01); *F04B 45/04* (2013.01); *F04B 45/043* (2013.01); *F04B 45/053* (2013.01); *F04B 53/16* (2013.01)

(58) Field of Classification Search

CPC ..... F04B 39/14; F04B 39/121; F04B 53/22; F04B 53/16; F04B 45/043; F04B 45/053; F04B 45/04; F04B 43/025; F04B 43/026; F04B 43/06

See application file for complete search history.

(56) References Cited

U.S. PATENT DOCUMENTS

| | | | | |
|---|---|---|---|---|
| 3,022,740 A * | 2/1962 | Wilfley | ..... | F04D 29/605 415/126 |
| 3,169,486 A | 2/1965 | Freed | | |
| 4,877,984 A | 10/1989 | Colwell et al. | | |

(Continued)

OTHER PUBLICATIONS

International Search Report & Written Opinion re PCT/US20/15479, dated Apr. 20, 2020.

*Primary Examiner* — Christopher S Bobish

(74) *Attorney, Agent, or Firm* — Karish & Bjorgum, PC

(57) ABSTRACT

A pump assembly includes a pump and a base. The pump has mounts located at multiple positions on the pump to effect different configurations of the assembly. Each mount includes two engagements spaced apart on the pump. The base has a retainer constructed to slidably engage one engagement and a seat constructed to support the other engagement. The seat has a socket with two holes extending into the base. A bracket includes a jaw engageable with the second engagement and two locking pins extending from the bracket for sliding engagement with the socket. The locking pins retain the bracket and jaw from moving away from the base. A fastener engages the bracket with the base so the two locking pins cannot slidably disengage the socket.

6 Claims, 6 Drawing Sheets

(56) References Cited

U.S. PATENT DOCUMENTS 4,900,224 A * 2/1990 Timperi ..... F04D 29/605 415/213.1
5,184,941 A * 2/1993 King ..... F04B 35/04 248/674
5,221,192 A * 6/1993 Heflin ..... F16F 1/373 248/638
5,354,182 A * 10/1994 Niemiec ..... F01C 21/007 248/638
D382,277 S * 8/1997 Feitel ..... D15/7
5,760,513 A 6/1998 Morishita et al.
5,860,794 A * 1/1999 Hand ..... F04B 9/135 417/393
6,336,794 B1 * 1/2002 Kim ..... F04B 39/0044 417/363
D512,441 S * 12/2005 Iwata ..... D15/7
7,614,855 B2 * 11/2009 Cook ..... F04B 17/03 264/674
8,066,028 B2 * 11/2011 Kees ..... F15B 13/0814 137/315.09
8,109,741 B2 * 2/2012 Huang ..... F04D 13/16 417/423.1
8,360,745 B2 * 1/2013 Dietzsch ..... F04B 43/0736 417/298
9,862,267 B2 2/2018 Gerhardt et al.
D817,360 S 5/2018 Dietzsch
2003/0030021 A1 * 2/2003 Hawkins ..... F15B 13/0821 251/291
2005/0095152 A1 * 5/2005 Dale ..... F04B 49/22 417/477.2
2011/0186709 A1 * 8/2011 Stupnik ..... F04B 39/14 248/618
2016/0201663 A1 * 7/2016 Treml ..... F04B 45/0536 417/63
2019/0170132 A1 * 6/2019 Zhang ..... F04B 39/121

* cited by examiner

PUMP ASSEMBLY

BACKGROUND OF THE INVENTION

The field of the present invention is pumps.

Many pumps have the capability of operating in multiple orientations. An advantage of this capability is that the pump may be oriented to most conveniently interface with plumbing and other devices associated with the pump. The pump also may be oriented to most conveniently be stably supported or fixedly mounted to existing structure.

Many applications for certain types of pumps such as air driven diaphragm pumps are advantaged by secure attachment because of unbalanced accelerations during operation. At the same time, such pumps have versatile capabilities and operate in multiple orientations, making them useful as tools taken from application to application. A secure and versatile mounting can be advantageous.

SUMMARY OF THE INVENTION

The present invention is directed to the assembly of a pump with a base. To accomplish the assembly, a mount includes a retainer and a seat on the base to mount the pump having two mutually-displaced engagements. A bracket cooperates with the seat to capture one of the engagements. The bracket includes a jaw and a locking device with a surface facing the jaw. The locking device engages with a socket in the base. The jaw and the seat thus retain the pump. A fastener engages both the bracket and the base to retain the bracket locked with the engagement of the mount. With multiple mounts, the base can be mountable in various orientations to the pump engagements.

In the preferred embodiment, an air driven diaphragm pump has a generally cylindrical shape with inlet and outlet manifolds adjacent to one another extending from the periphery. The pump has a plurality of angularly spaced mounts, each with two engagements. Each engagement is defined by opposite facing, uniformly spaced surfaces on the pump. There are three mounts angularly spaced at 90° from the most adjacent mount, allowing three pump orientations. The engagements of each mount being opposite facing, uniformly spaced surfaces, the pump may be engaged with the base in either direction with any of the three mounts.

The base is a functional plate. A hole therethrough accommodates the ports in one pump orientation. The base retainer is conveniently a passive hook spaced from the base to receive the spaced surfaces of an engagement on the pump. A seat also passively receives the associated engagement. The bracket includes a jaw that is spaced from the seat to meet the spaced surfaces of the associated engagement of the mount when the bracket is positioned on the seat. There are two locking pins on the bracket that engage the socket in the seat with the bracket positioned on the base. These locking pins include lugs facing the jaw which engage undercut sections in the socket by sliding the bracket on the base. The lugs engaging the socket retain the bracket in engagement with the pump. The fastener, cooperating with an aligning post and channel, is used to keep the lugs engaged with the socket.

Accordingly, it is a principal object of the present invention to provide a versatile pump and mounting assembly. Other and further objects and advantages will appeal hereinafter.

DETAILED DESCRIPTION OF THE PREFERRED EMBODIMENTS

Figure 2:
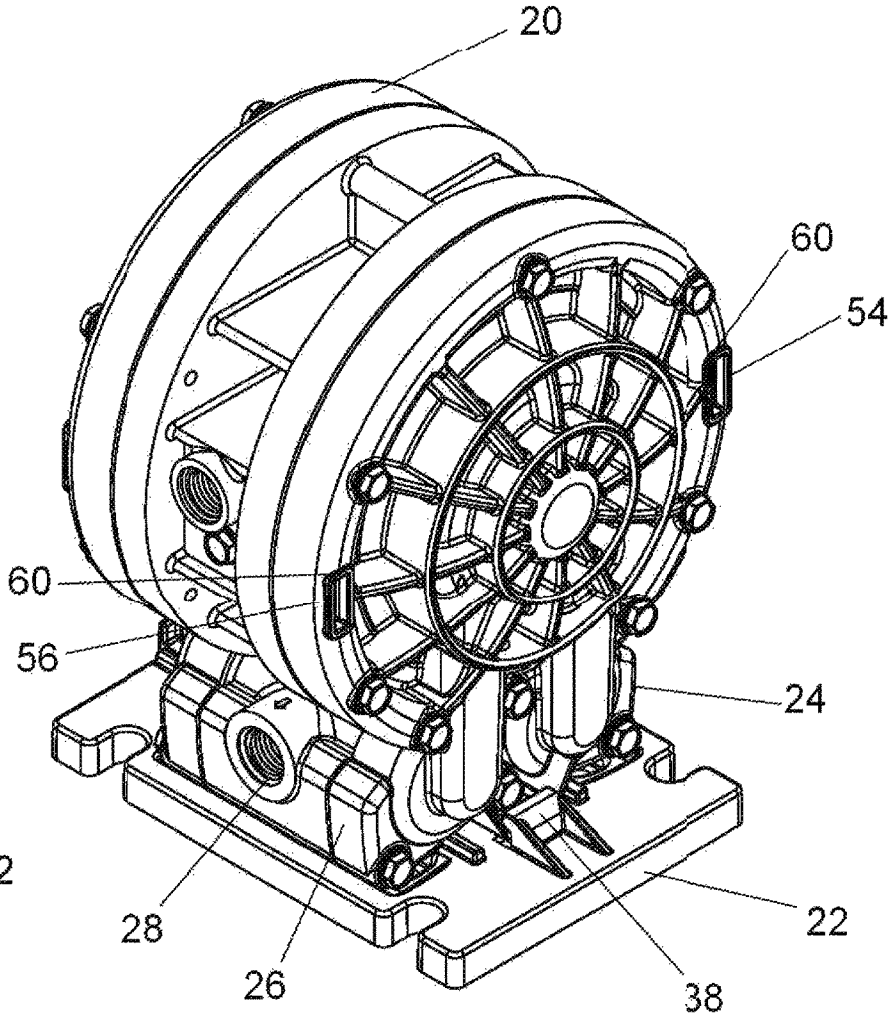
FIG. 2 is an isometric view of the pump assembly illustrating the seat and bracket of the base with the pump in the first orientation.

Turning in detail to the drawings, a pump 20 is illustrated with a base 22 in a single preferred embodiment in all of FIGS. 1 through 14. The pump illustrated is an air driven double diaphragm pump generally cylindrical in configuration with inlet and outlet manifolds 24, 26 adjacent one another and extending from the periphery of the generally cylindrical pump body. The manifolds 24, 26 each include two ports 28, 30 at 90° to one another for added versatility of attachment for pumped fluid. As visible in FIGS. 13 and 14, one of the two ports 28, 30 on each may be blocked by a threaded plug 32 to provide a single inlet and single outlet for the pumped fluid to and from the pump 20.

The base 22 is a functional plate having a central hole 34 therethrough. The base 22 further includes four mounting holes 36 for affixing the base to a structure. A retainer 38 located on the surface of the base 22 defines a hook with a fixed space between the surface of the base 22 and the hook of the retainer 38. The base 22 further includes a seat 40, which in the preferred embodiment is part of the surface of the base 22. The seat includes a socket defined by two holes 44, 46 to either side of a planar portion of the seat 40. Each of the two holes 44, 46 has an undercut section in the base covered by base portions 48, 50.

The pump 20 includes a plurality of mounts. There is a central mount 52 located adjacent the inlet manifold 24 and outlet manifold 26 and two side mounts 54, 56 placed on the pump 20 at 90° in each direction from the most adjacent central mount 52. Each mount 52, 54, 56 includes two engagements displaced from one another to either side of the pump 20. Each of these mutually displaced engagements includes two opposite facing, uniformly spaced surfaces on the pump 20. In the case of the central mount 52, each engagement 58 is a plate on the pump 20 with access to both sides of the plate. The engagements 60 of the side mounts 54, 56 are defined by holes 60 in the pump case and the outside periphery of the pump case where the pump is cradled by the base 22. The surface of each of the holes 60 of the side mounts 54, 56 most adjacent the outer periphery is spaced the same distance from the base 22 with the pump 20 positioned on the base 22.

Figure 1:
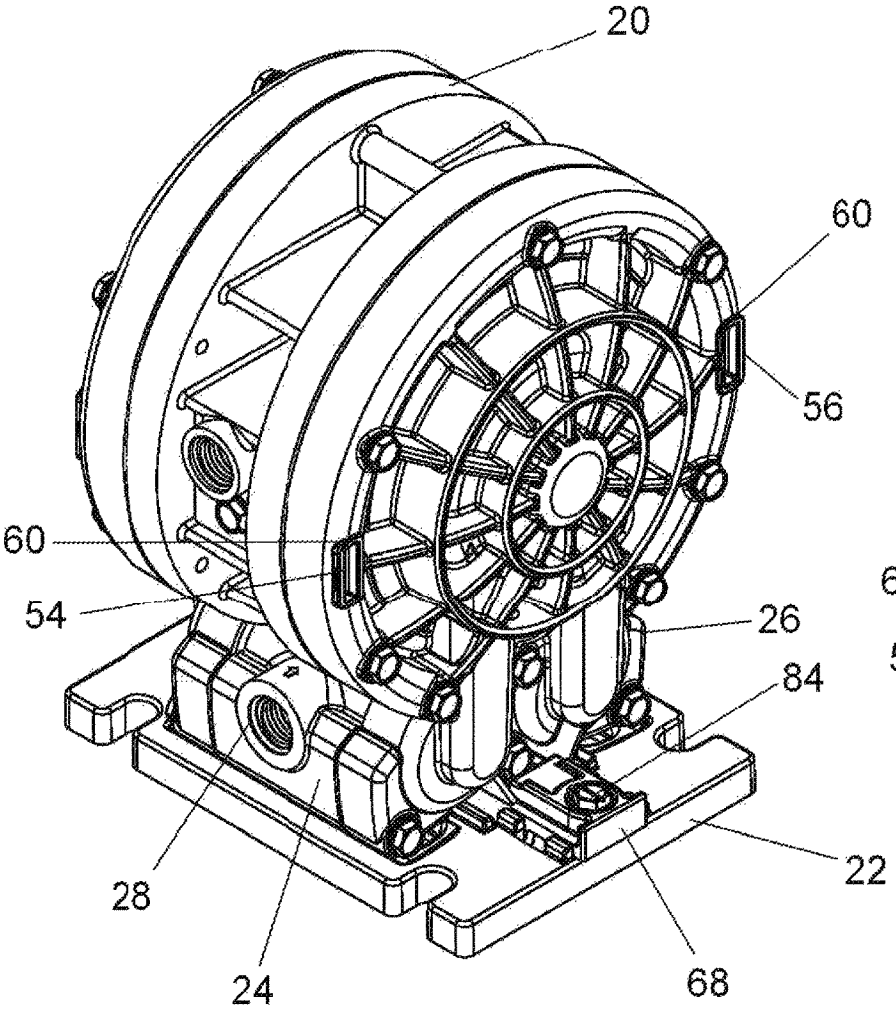
FIG. 1 is an isometric view of a pump assembly illustrating the retainer of the base with the pump in a first orientation.
Figure 4:
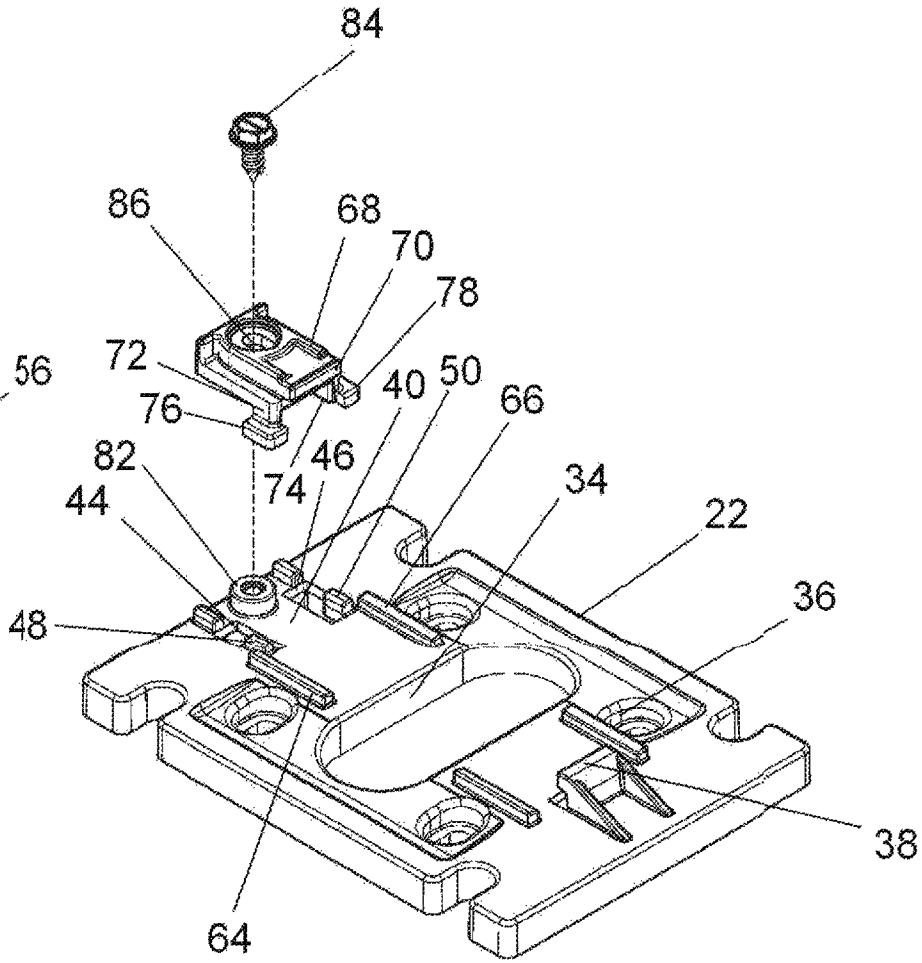
FIG. 4 is an isometric exploded assembly view of the base, bracket and fastener of the assembly.
Figure 3:
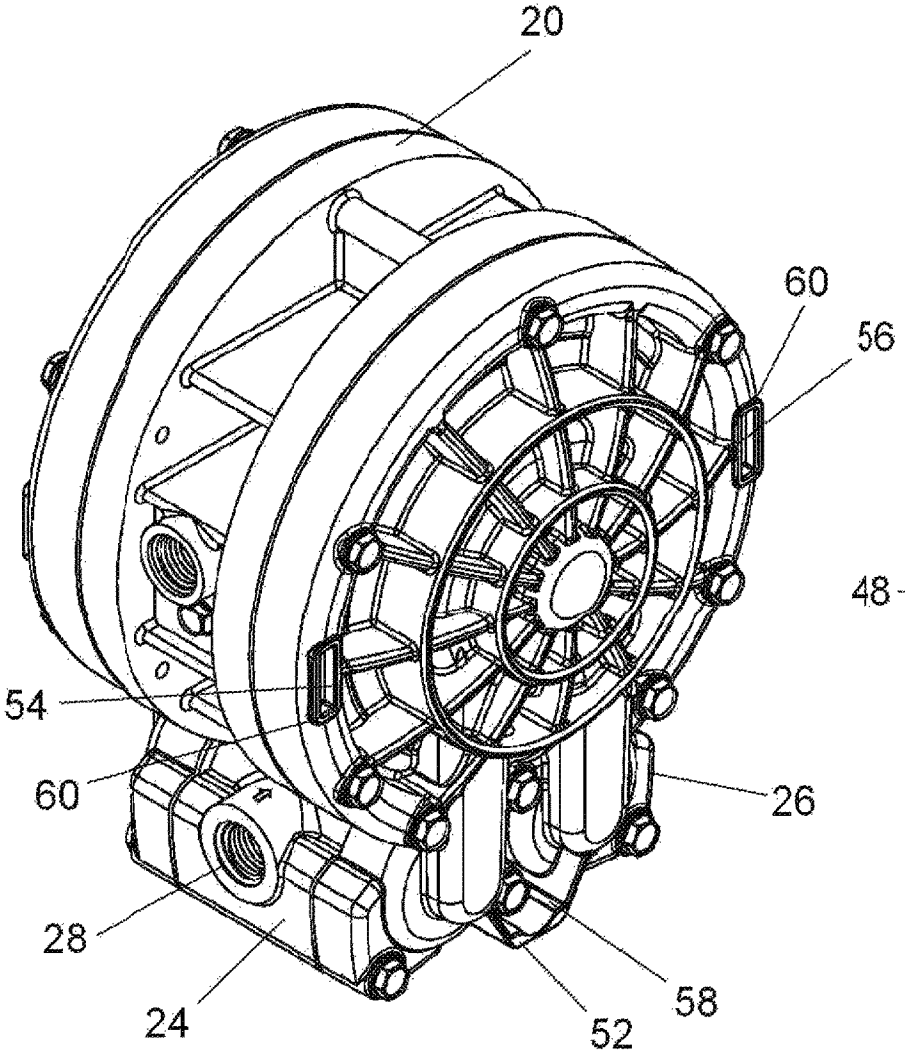
FIG. 3 is an isometric view of the pump without a base assembled therewith.
Figure 5:
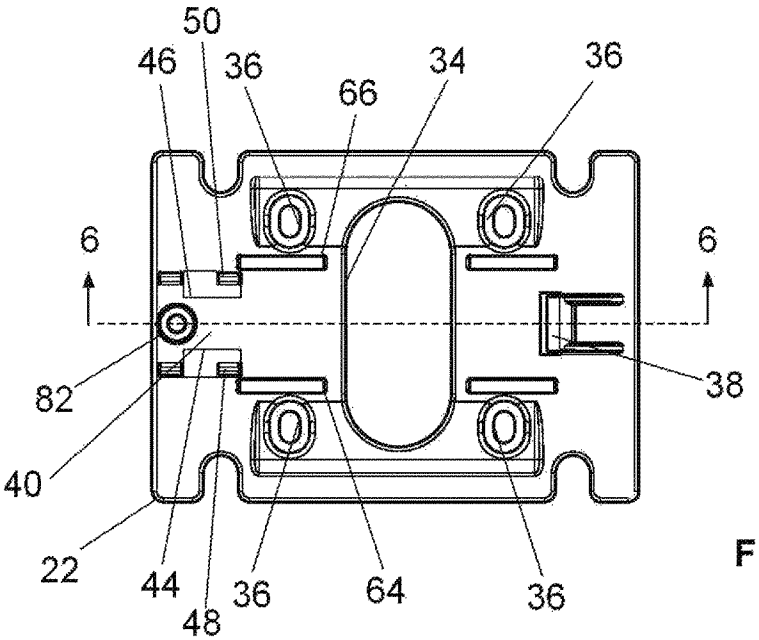
FIG. 5 is an orthographic plan view of the base of the pump assembly.
Figure 14:
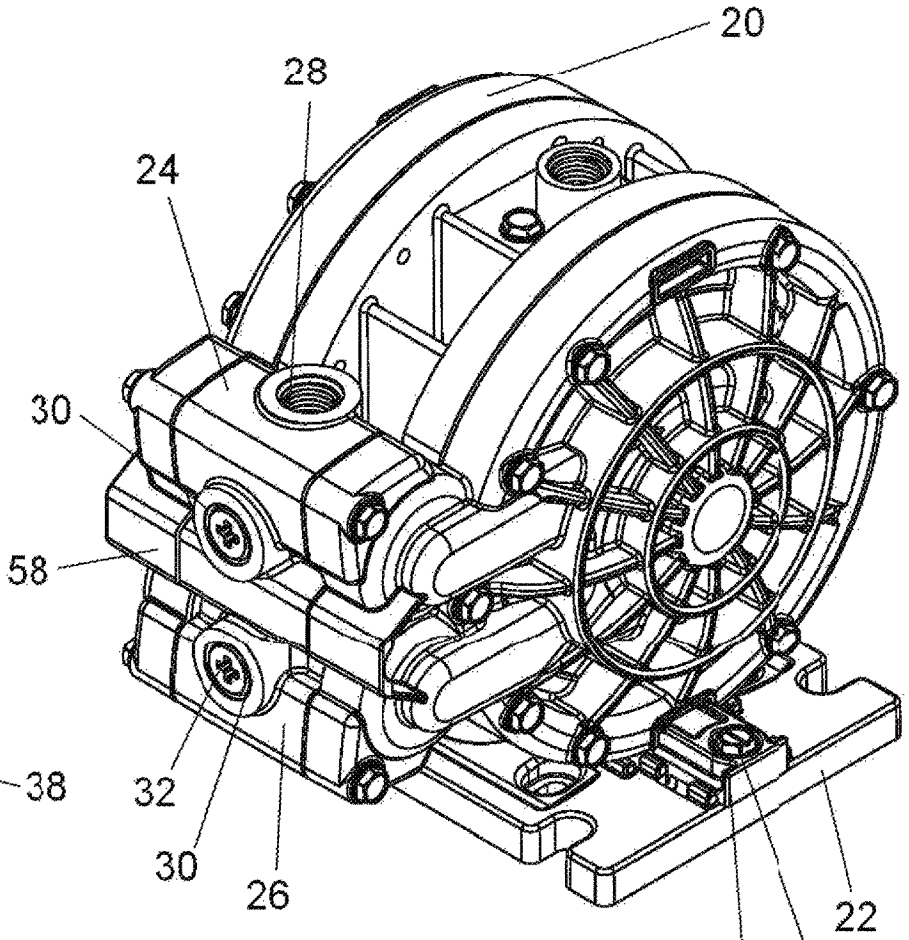
FIG. 14 is an isometric view of the pump assembly illustrating the seat and bracket of the base with the pump in the second orientation.
Figure 13:
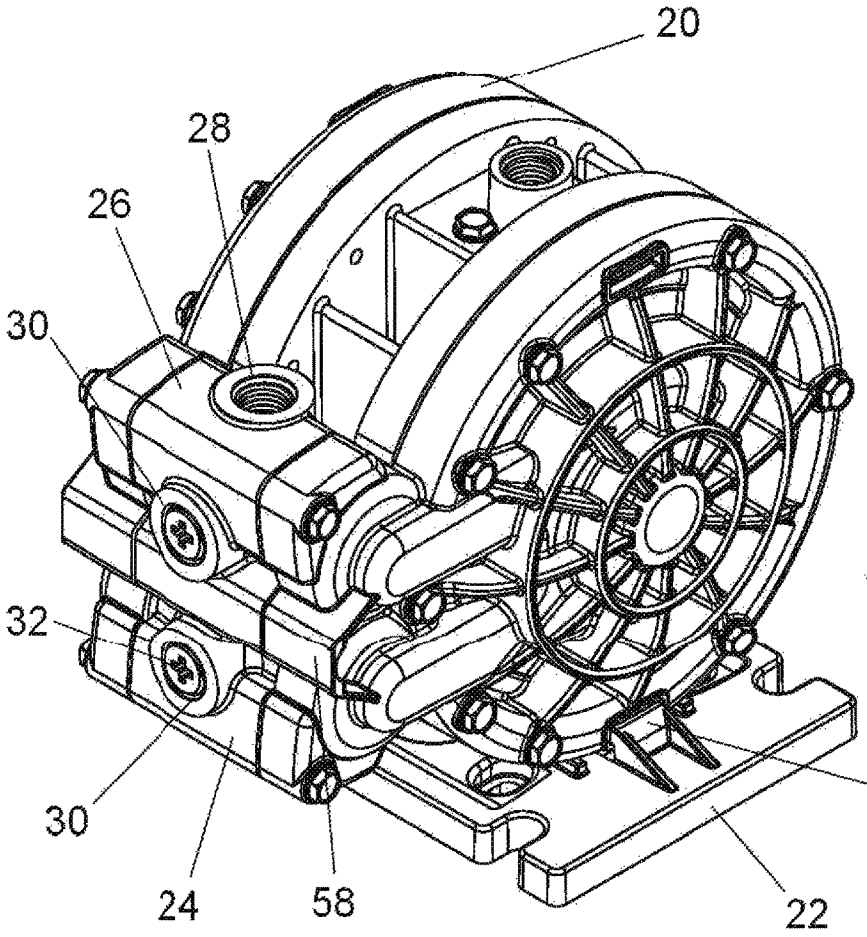
FIG. 13 is an isometric view of the pump assembly illustrating the retainer of the base with the pump in a second orientation.

In the preferred embodiment with three mounts 52, 54, 56, the pump 20 may be secured to the base 22 in two orientations, with the manifolds 24, 26 at the base 22 and with the manifolds 24, 26 extending laterally in either direction relative to the base 22. FIGS. 1 and 2 illustrate the first pump orientation, while FIGS. 13 and 14 illustrate the second orientation with the manifolds 24, 26 extending laterally relative to the base 22. The mounts 52, 54, 56, have the same attachment spacing at each engagement 58, 60 to provide for the retainer 38 and the base 22 to receive either engagement 58, 60. It is noted that the base 22 is rotated 180° between the views in FIGS. 1 and 2 and also rotated the same between the views in FIGS. 13 and 14.

When the central mount 52 is associated with the base 22, a planar portion 62, exposed in FIGS. 13 and 14, rests on the base 22. In this orientation, the retainer 38 and the seat 40 are to either end of the planar portion 62. With the manifolds 24, 26 extending laterally, one or the other of the holes associated with the side mounts 54, 56 are aligned with the retainer 38 and seat 40. Cradle elements 64, 66 on the surface of the base 22 receive the cylinder-like sidewall of the pump 20. To engage the pump 20 and the base 22 into position on either the planer portion 62 or the cradle elements 64, 66, the engagement 58, 60 on one side of the pump 20 can be first slidably engaged with the retainer 38 on the base 22. With the engagement 58, 60 in place with the retainer 38, the engagement 58, 60 on the other side of the pump can be passively received by the seat 40 or the cradle elements 64, 66.

Figure 7:
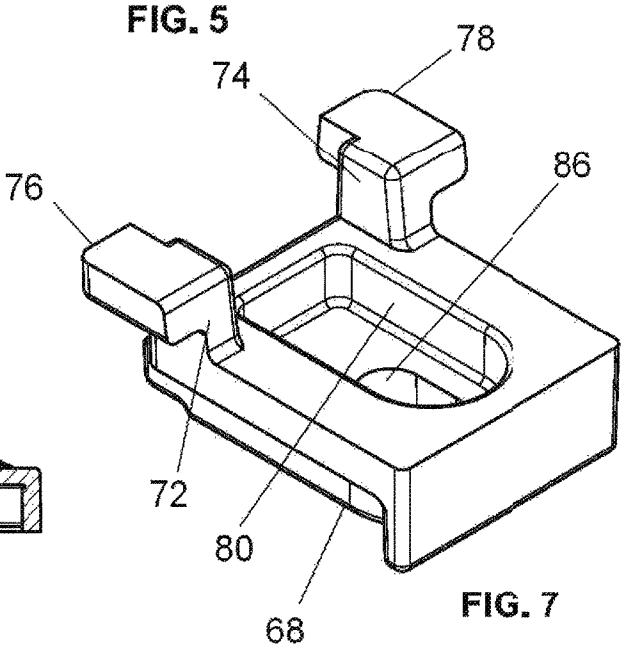
FIG. 7 is an isometric bottom view of the bracket of the pump assembly from the back end of the bracket.
Figure 6:
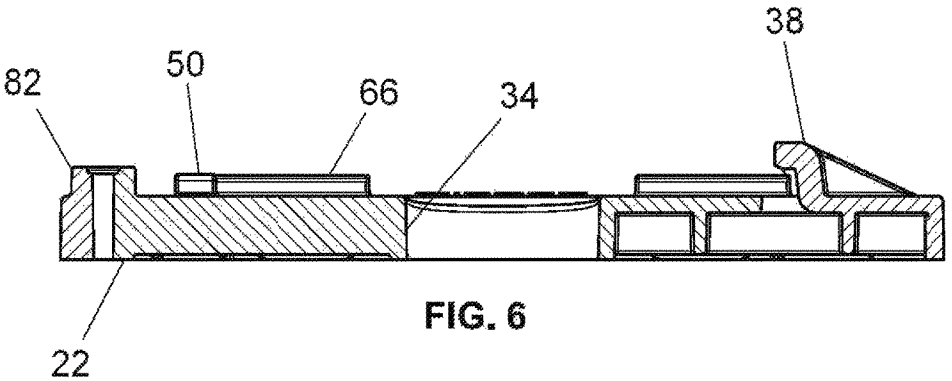
FIG. 6 is a cross-sectional view of the base taken along line 6-6 of FIG. 5.
Figure 9:
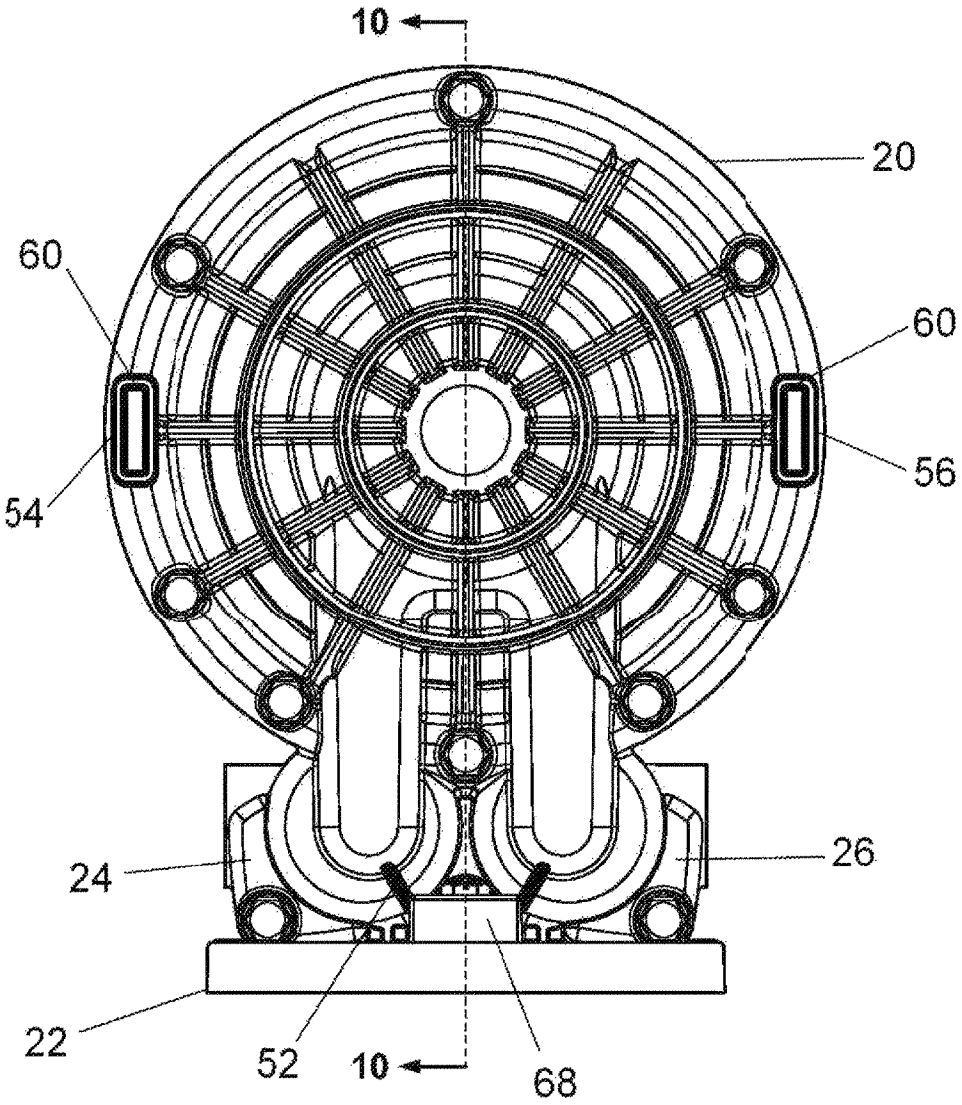
FIG. 9 is a front view of the pump assembly illustrating the bracket of the mount with the base in the first orientation.
Figure 8:
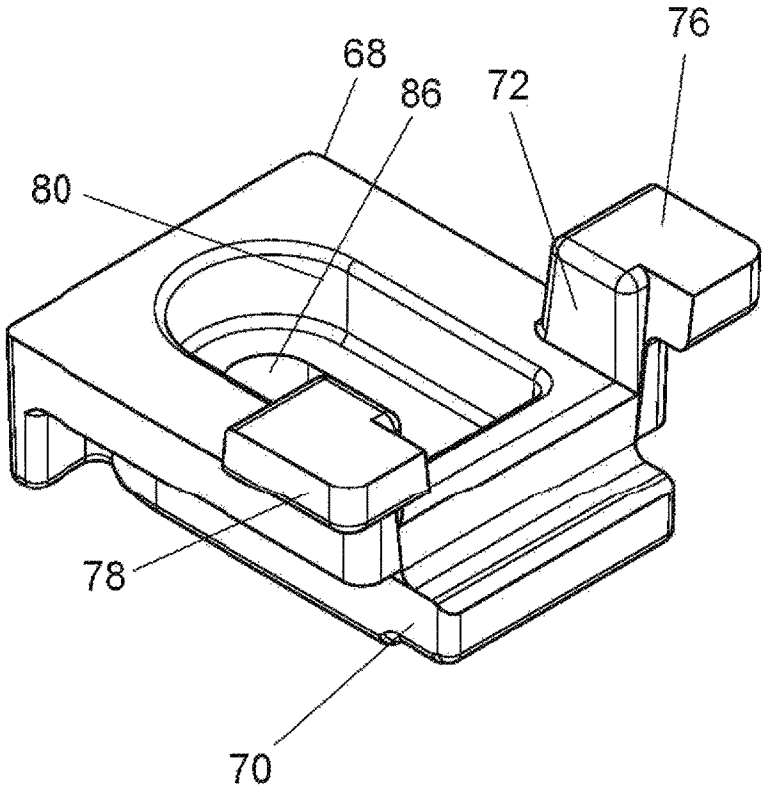
FIG. 8 is an isometric bottom view of the bracket of the pump assembly from the jaw end of the bracket.
Figure 11:
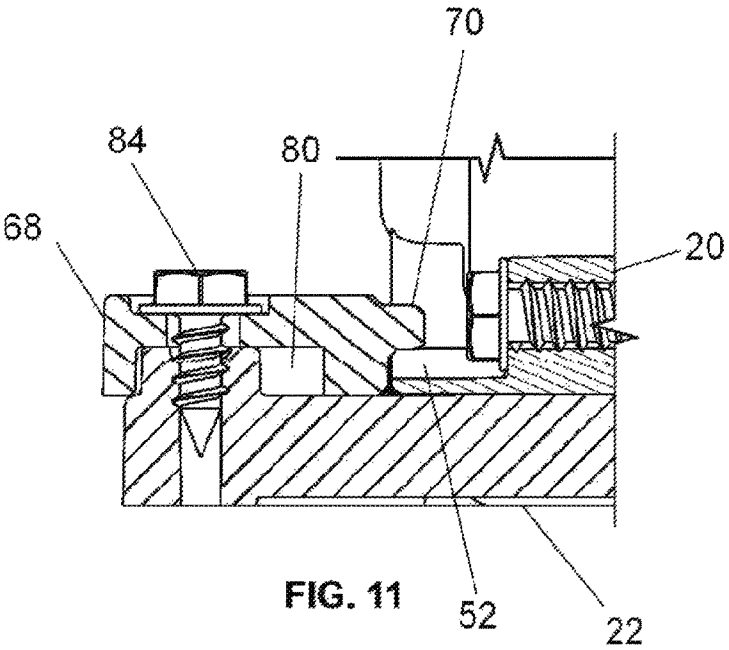
FIG. 11 is a detail view of the bracket assembly as shown in cross section in FIG. 10.
Figure 12:
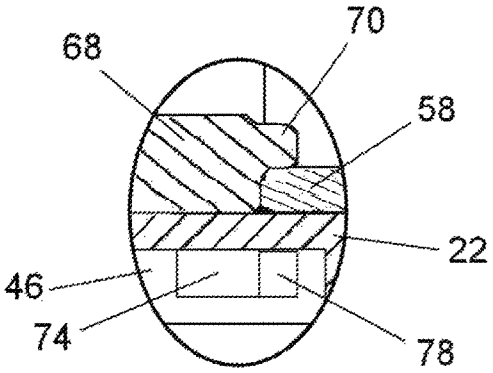
FIG. 12 is a detail view of the bracket assembly taken in cross section through a hole in the slot of the base.
Figure 10:
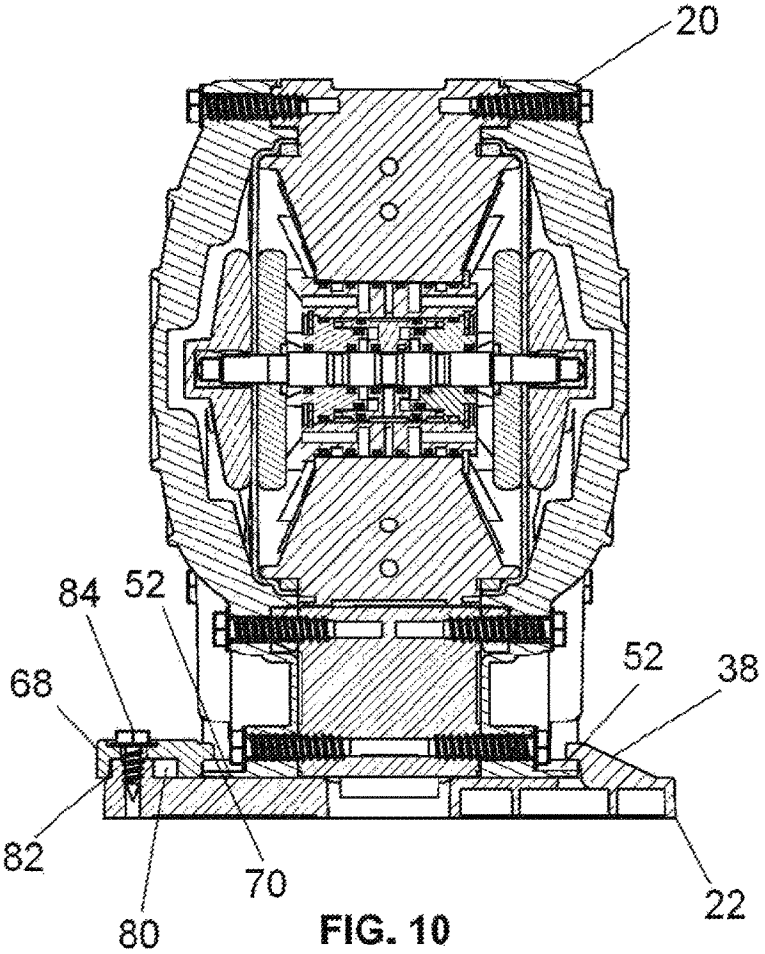
FIG. 10 is a cross-sectional view of the pump assembly taken along line 10-10 of FIG. 9.

A bracket 68 as shown in detail in FIGS. 7, 8 and 11, is to be associated with the seat 40 and the socket. The bracket 68 includes a jaw 70. The jaw 70 is positioned the same distance from the seat when the bracket 68 is on the seat 40 as the distance between the opposite facing, uniformly spaced surfaces of the engagements 58, 60. The bracket further includes locking pins 72, 74 which extend through the holes 44, 46 of the socket 42. Two lugs 76, 78 are located at the ends of the locking pins 72, 74. The upper surfaces of these lugs 76, 78 face the jaw 70. These surfaces are spaced below the underside of the bracket 68 by a distance equal to the thickness of the base 22 between the seat 40 and the undercut sections of the two holes 44, 46 in the socket.

With the bracket 68 in place, the jaw 70 is located above the surface of the bracket 68 to receive the engagement 58, 60; and the surfaces of the lugs 76, 78 facing the jaw 70 are located below the surface of the base 22 to engage the undercut sections defined by the base portions 48, 50 through the holes 44, 46 of the socket 42. See the FIG. 12 detail. When the lugs 76, 78 are so engaged with the base 22, the jaw 70 retains the engagement 58, 60 on the base 22 because of the engagement of the lugs 76, 78 with the base 22 independently of any fastener.

The bracket 68 further includes a channel 80; and the base 22 includes a post 82 extending into the channel 80. Because of the channel 80 and because the two holes 44, 46 in the socket 42 also provide clearance, the bracket 68 can be in sliding engagement and disengagement of the lugs 76, 78 with the undercut sections of the two holes 44, 46 of the socket. Thus, the bracket 68 has a locked position with the engagement 58, 60 and an unlocked position displaced from the engagement 58, 60.

A fastener 84 is positioned in the bracket 68 through an access hole 86 into the channel 80. The fastener 84 is threaded into the post 82 where it is retained. With the fastener 84 not compressing against the bracket 68, the bracket 68 can be slid back and forth into and out of engagement with the engagement 58, 60. With the fastener 84 tightened to compress against the bracket 68 and with the bracket 68 advanced to engage the jaw 70 with the engagement 58, 60 and the lugs 76, 78 with the undercut portions of the socket, the bracket is locked in place and the engagement secured. The holding force of the bracket 68 on the engagement 58, 60 is provided by the lugs 76, 78 and not by the fastener 84. Rather, the fastener simply is used to resist sliding of the bracket 68 into and out of engagement with the engagement 58, 60.

The components of the pump assembly are such that there is flexibility available for assembly of the base 22 and pump 20. FIGS. 1 and 2 reflect the first two orientations with the base 22 reversed relative to the pump 20. The same is true for the third and fourth orientations of the pump 20 with the base 22 reflected in FIGS. 13 and 14. The three engagements 58, 60 add further flexibility. Additional configurations are available by choosing one or the other of the ports 28, 30 in each of the inlet manifold 24 and outlet manifold 26.

Thus, a pump assembly with a versatile and secure mounting is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A pump assembly comprising an air driven diaphragm pump with a housing, an intake port and an outlet port, the ports being adjacent one another on a periphery of the housing, the pump including at least two mounts, each mount including a pair of engagements spaced apart on the pump, the mounts being angularly displaced from one another;

a base including a retainer constructed to slidably engage a first engagement of the pair of engagements and a seat constructed to support a second engagement of the pair of engagements with the retainer slidably engaged with the first engagement of the pair of engagements, the seat having a socket;

a bracket including a jaw engageable with the second one of the pair of engagements and a locking pin having a surface facing the jaw and engageable with the socket;

a fastener engaged with the bracket and the base with the locking pin engaged with the socket;

the base having a central hole therethrough receiving the ports with the pump mounted to the base at a first of the at least two mounts, and having spaced cradle elements supporting the pump with the pump mounted to the base at a second of the at least two mounts with the ports angularly displaced from the central hole.

2. A pump assembly comprising a pump including at least one mount, each mount including two engagements spaced apart on the pump;

a base including a retainer constructed to slidably engage a respective first engagement of the pair of engagements and a seat constructed to support a respective second engagement of the pair of engagements with the retainer slidably engaged with the first engagement of the pair of engagements, the seat having a post and a socket having two holes extending into the base, each of the two holes having an undercut section in the base;

a bracket including a channel, a jaw engageable with the second engagement of the pair of engagements and two locking pins extending from the bracket, each of the two locking pins having a lug with a surface facing the jaw and engageable in one of the holes with one of the undercut sections, respectively, the channel receiving the post with the socket holes receiving the locking pins, the bracket sliding on the seat with the channel positioned about the post, the second of the two engagements being fixed between the seat and the jaw with the lugs engaged with the undercut sections;

a fastener engaging the bracket and the post of the seat with the lugs engaged with the undercut sections.

3. The pump assembly of claim 2, the fastener restraining the locking pins from lateral disengaging from the socket.

4. The pump assembly of claim 2, the retainer and the jaw constructed to engage each of the respective engagements.

5. The pump assembly of claim 2, the pump including two mounts, the mounts being perpendicular to one another.

6. The pump assembly of claim 5, the pump being an air driven diaphragm pump with a housing, an intake port and an outlet port, the ports being adjacent one another on a periphery of the housing, the base having a central hole therethrough receiving the ports with the pump mounted to the base at a first of the two mounts and having spaced cradle elements supporting the pump with the pump mounted to the base at a second of the two mounts with the ports angularly displaced from the central hole.

* * * * *